US006039473A

United States Patent [19]

Bond

[11] Patent Number: 6,039,473

[45] Date of Patent: Mar. 21, 2000

[54] TAMPER EVIDENT FILE HOLDER CONFIGURED FOR HANGING IN A FILE CABINET

[76] Inventor: Bruce Bond, 9 The Eyrie, Eaglemont, Victoria 3084, Australia

[21] Appl. No.: 09/252,316

[22] Filed: Feb. 18, 1999

[51] Int. Cl.[7] ..... B65D 33/34

[52] U.S. Cl. ..... 383/5; 383/23; 229/67.2; 229/67.4; 312/184; 190/120; 190/901

[58] Field of Search ..... 229/67.1, 67.2, 229/67.3, 67.4; 383/22, 23, 14, 5, 97; 190/900, 901, 903, 120; 312/184

[56] References Cited

U.S. PATENT DOCUMENTS

| | | | |
|---|---|---|---|
| 2,778,397 | 1/1957 | Carrasco | 190/901 X |
| 4,400,107 | 8/1983 | Pitts | 312/184 X |
| 4,793,495 | 12/1988 | Preu | 312/184 X |
| 4,817,769 | 4/1989 | Saliba | 190/900 X |
| 5,163,606 | 11/1992 | Isserstedt | 229/67.2 |
| 5,226,734 | 7/1993 | Scott et al. | 229/67.2 X |
| 5,328,259 | 7/1994 | Meriaux | 229/67.2 X |
| 5,620,133 | 4/1997 | Isserstedt | 383/23 X |

*Primary Examiner*—Jes F. Pascua
*Attorney, Agent, or Firm*—Leonard Tachner

[57] ABSTRACT

A tamper evident file holder especially suited for use in containing hanging files in a file cabinet drawer. The file holder is normally a full enclosure pouch configured for holding a plurality of files with one access portal such as a zippered closure or the like. In the preferred embodiment disclosed herein, the enclosure is made of a heavy fabric such as leather, vinyl, canvas, nylon or other tear resistant material. The zipper is locked in the closed position by a locking device comprising a disposable element in the form of a plug and stem which must be fractured to permit unlocking the locking device to open the zipper and gain access to the interior of the pouch. By coding each disposable element with a unique and indelible code, one can readily ascertain that the zipper has been unlocked to permit access to the files within the pouch. The pouch is preferably configured with hanger rods to permit hanging the file holder on a standard pair of file cabinet drawer rails. In the preferred embodiment, the hanger rods are affixed to the pouch by flaps which form elongated compartments on the opposing sides of the pouch.

7 Claims, 3 Drawing Sheets

TAMPER EVIDENT FILE HOLDER CONFIGURED FOR HANGING IN A FILE CABINET

BACKGROUND OF THE INVENTION

1. Field of the Invention

The present invention relates generally to document security devices and more particularly to a tamper evident file holder configured for hanging in a file cabinet and having an enclosed pouch secured by a locking device that can be opened only by leaving evidence of such opening.

2. Prior Art

The concern for the security of industrial information is a continuous and growing issue. Companies spend millions of dollars to develop new products which must be kept confidential until ready for the marketplace. Some companies rely on trade secrecy to safeguard critical industrial information, the value of which could be critically depleted if revealed to competitors. Many companies rely on confidentiality to preserve internal personnel files in secrecy to prevent morale problems among employees. One solution to industrial security concerns is to simply lock up all such information such as by using U. S. Defense Department type file cabinets with combination locks. However, such locked file cabinets are sometimes very inconvenient, particularly if there are many non-confidential files stored in the same cabinet with confidential files.

One remedy to such inconvenience is to use secure file storage within a file cabinet drawer for sensitive files while leaving non-sensitive files exposed to view. One way of providing a secure file storage device is to lock a file enclosure into the drawer of a file cabinet. However, that form of security would be expensive and cumbersome. Another form of file security for a file cabinet drawer would be a form which provides irrefutable evidence of tampering so that it is obvious that someone has gained access to confidential files. Such a system for file security would be highly advantageous if it were inexpensive and convenient to use.

SUMMARY OF THE INVENTION

The present invention comprises a tamper evident file holder especially suited for use in containing hanging files in a file cabinet drawer. The file holder is normally a full enclosure pouch configured for holding a plurality of files with one access portal such as a zippered closure or the like. In the preferred embodiment disclosed herein, the enclosure is made of a heavy fabric such as leather, vinyl, canvas, nylon or other tear resistant material. The zipper is locked in the closed position by a locking device comprising a disposable element in the form of a plug and stem which must be fractured to permit unlocking the locking device to open the zipper and gain access to the interior of the pouch. By coding each disposable element with a unique and indelible code, one can readily ascertain that the zipper has been unlocked to permit access to the files within the pouch. The pouch is preferably configured with hanger rods to permit hanging the file holder on a standard pair of file cabinet drawer rails. In the preferred embodiment, the hanger rods are affixed to the pouch by flaps which form elongated compartments on the opposing sides of the pouch. However, other devices, such as hooks and chains could be affixed to the ends of the pouch and used to hang the file holder on the file cabinet rails. Of particular relevance to the present invention is U. S. Pat. No. 3,955,842 to Edwards which discloses a locking device for use with a zipper and which may be used in the present invention to provide evidence of tampering as will be discussed hereinafter.

OBJECTS OF THE INVENTION

It is therefore a principal object of the present invention to provide a tamper evident file holder for use in file cabinet drawers.

It is another object of the invention to provide a hanging file holder that is fully enclosed, openable only by a locking device that provides evidence of opening.

It is yet another object of the invention to provide a tamper evident document file pouch having hanger rods for supporting documents in a file cabinet drawer while providing irrefutable evidence that someone has gained access to the interior of such file pouch.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
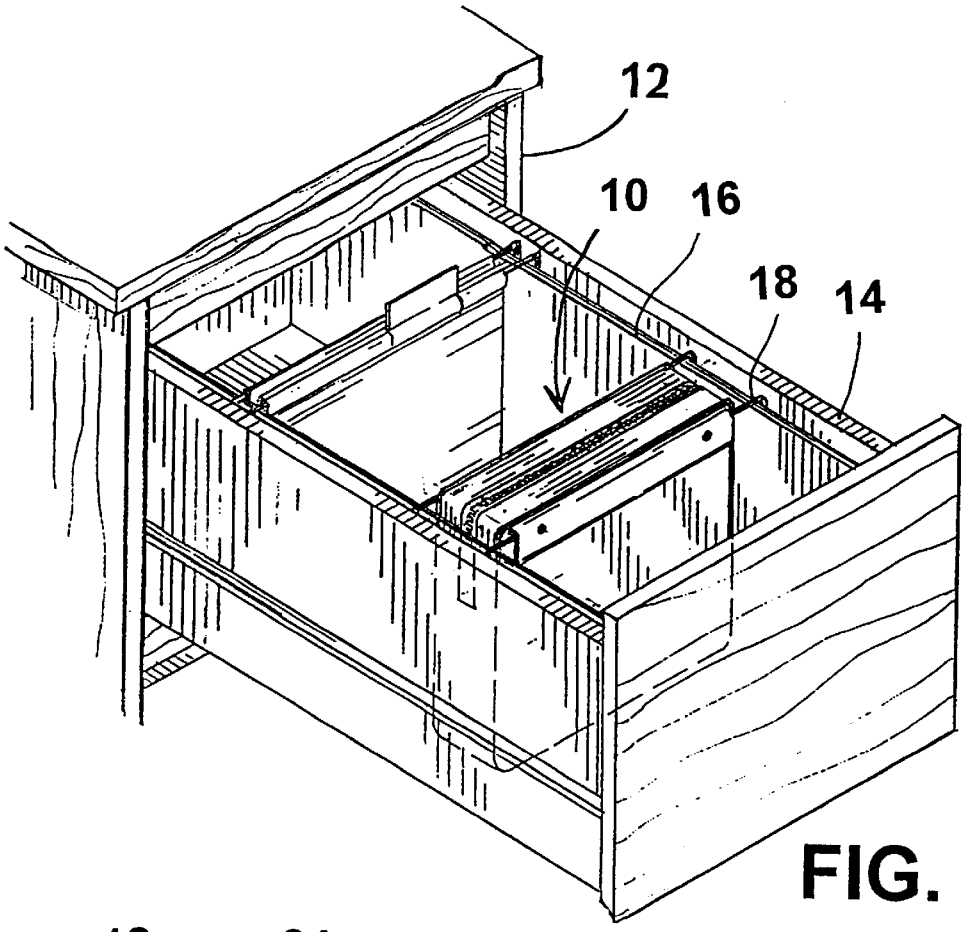
FIG. 1 is a three-dimensional view of the invention shown in a hanging position on rails in a file cabinet drawer.
Figure 2:
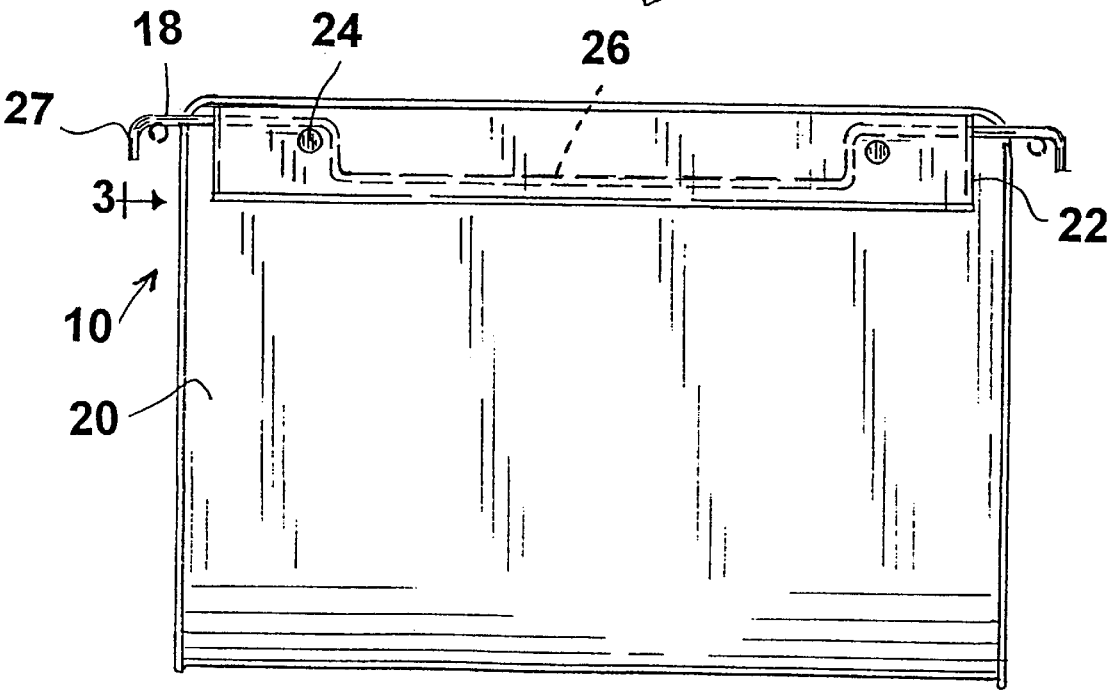
FIG. 2 is an elevational front view of the invention.
Figure 3:
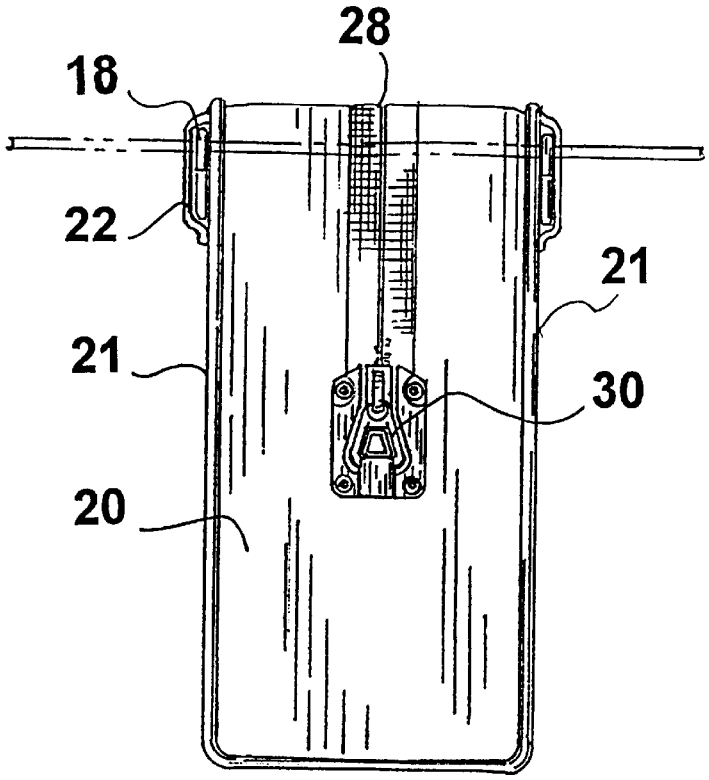
FIG. 3 is a side view of the invention showing the zipper and locking device.

Referring to the accompanying drawings, it will be seen that a tamper evident file holder 10 comprises a pouch 20 which is generally rectangular in shape and has generally flat sides 21 and a sewn flap 22 on each side. Threaded through each flap 22 is a hanger rod 18 which is held in place within the flap by a pair of pins 24. Each rod 18 has a central stepped portion 26 and respective hooked portions 27 at respective ends of the rod. The length of rod 18 and the distance between hooked portions 27 is selected to correspond to the standard separation between a pair of hanger rails 16 shown in FIG. 1. The interaction between rods 18 and rails 16 permits the pouch 20 to hang in a file drawer 14 of a cabinet 12. The pouch 20 may be configured to enclose a plurality of documents (four to six inches in total thickness). Of course, it will be understood that the thickness of pouch 20 may be selected to hold virtually any number of documents and that the dimensions illustrated in the drawings are merely illustrative and not limiting hereof.

Figure 4:
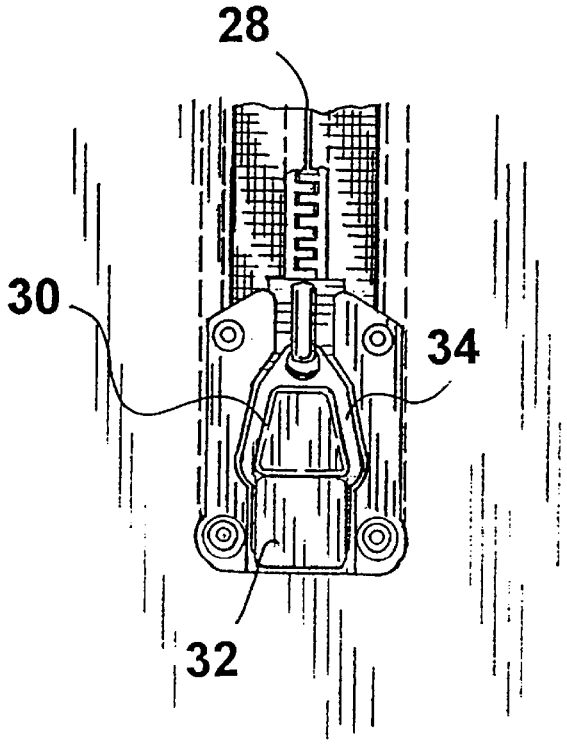
FIG. 4 is an enlarged view of the locking device.
Figure 5:
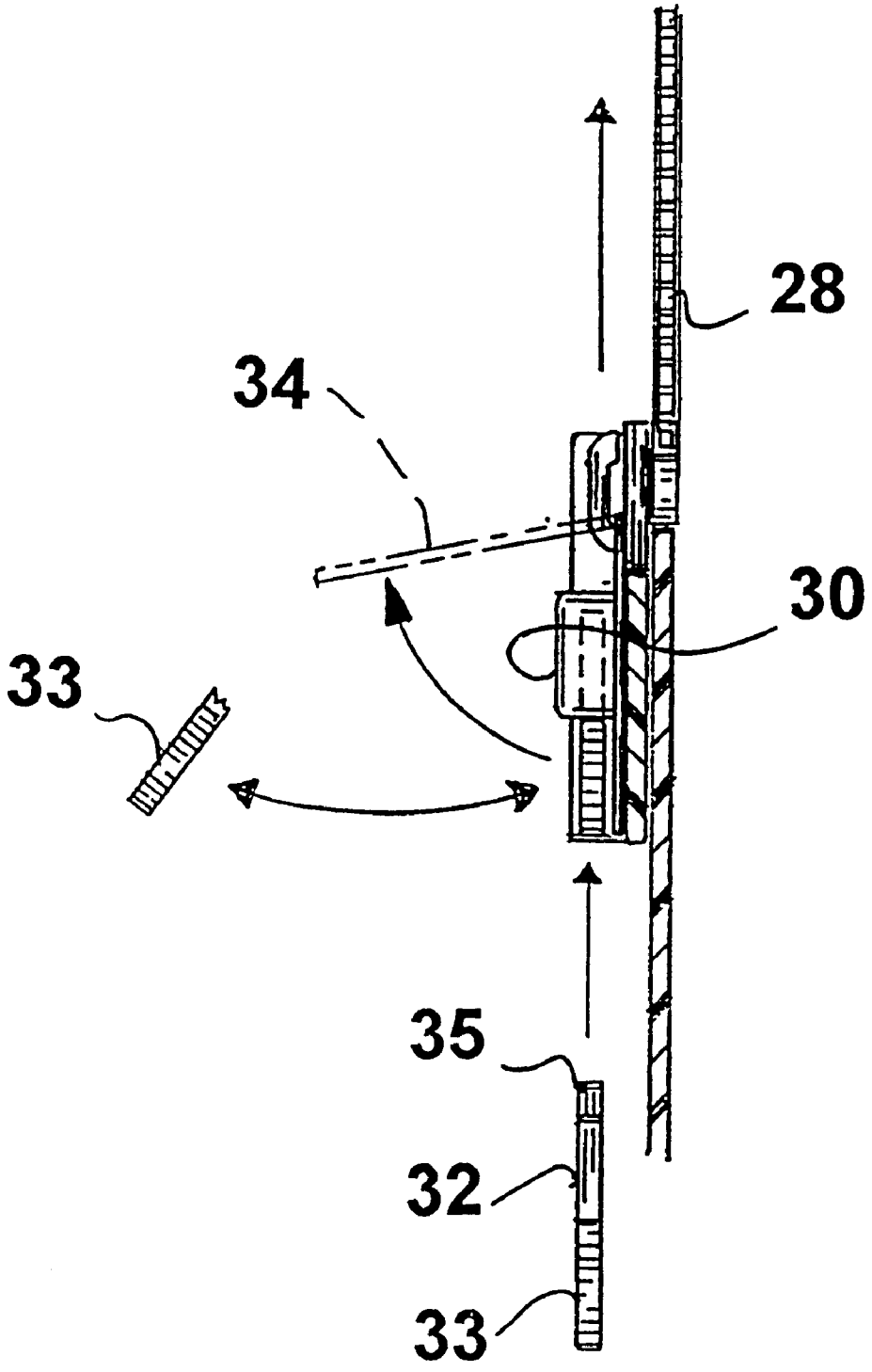
FIG. 5 is a side view of the locking device showing the manner in which it is locked and then subsequently unlocked.

The disclosed locking device 30 is described in U. S. Patent No. 3,955,842 in conjunction with FIGS. 4 and 5 of that patent and at column 4 line 59 to column 5 line 54. Thus the detailed structure of the locking mechanism need not be described herein. However, for purposes of convenience, the general structure is shown herein in FIGS. 4 and 5. As seen in those figures, zipper 28 has a tab 34 which is secured by the locking device 30. A disposable element 32 has a breakaway portion 33 and a forward portion 35. The disposable element, once inserted into locking device 30, cannot be withdrawn or otherwise removed without fracturing the element. By fracturing disposable element 32 so that breakaway portion 33 may be separated from forward portion 35, zipper tab 34 is freed and may be elevated from the locking device as shown in phantom in FIG. 5. Each time that the locking device is re-locked, a new disposable element 32 is inserted into the locking device and simultaneously expels the forward portion 35 of the previously used disposable element. Of course, each such disposable element may be uniquely coded in a unpredictable sequence so that unlocking of the locking device 32 leaves a tell-tale sign of opening zipper 28 that simply cannot be avoided.

Thus it will be seen that the present invention meets all of the above-stated objects of invention by providing a tamper evident file holder that is configured to be hung on file cabinet rails to provide a convenient and inexpensive means for securing confidential documents. Having thus disclosed a preferred embodiment of the invention, it being understood that other versions are contemplated, such as using other types of access other than zippers and other types of locking devices.

What is claimed is:

1. A tamper evident document file holder comprising:

a substantially rectangular pouch having dimensions compatible with standard file cabinet drawers, said pouch having two opposed substantially rectangular sides, each such side having a flap extending substantially the entire length of said pouch, the flap and the side forming an elongated, open-ended compartment;

a pair of elongated having rods, each such rod extending within a respective said compartment and extending beyond said pouch for hanging said pouch in a file cabinet drawer;

said pouch being fully enclosed except for a zippered opening having a zipper and a locking device, said locking device having means for providing evidence of each opening of said zipper;

wherein said hanging rods are trapped within said compartments for preventing rotation and translation of said rods within said compartments;

further comprising at least one pin extending through each said compartment for pinning said hanger rod.

2. The file holder recited in claim 1 wherein each said hanger rod comprises hooked ends for secure hanging of the pouch in a file cabinet drawer.

3. A tamper evident document file holder comprising:

a substantially rectangular pouch having dimensions compatible with standard file cabinet drawers, said pouch having two opposed substantially rectangular sides, each such side having a flap extending substantially the entire length of said pouch, the flap and the side forming an elongated, open-ended compartment;

a pair of elongated having rods, each such rod extending within a respective said compartment and extending beyond said pouch for hanging said pouch in a file cabinet drawer;

said pouch being fully enclosed except for a zippered opening having a zipper and a locking device, said locking device having means for providing evidence of each opening of said zipper;

wherein said hanging rods are trapped within said compartments for preventing rotation and translation of said rods within said compartments;

wherein each said hanger rod has an intermediate stepped portion to prevent rotation of the rod.

4. A tamper evident document pouch comprising:

a tear resistant, substantially rectangular enclosure having at least two hooked members extending longitudinally therefrom for hanging said pouch in a file cabinet drawer on file cabinet rails;

said enclosure having a unitary closure selectively secured in a closed configuration by a locking device, said locking device having means for opening only by leaving irrefutable evidence of such openings further comprising at least one gin for pinning said hooked members;

wherein said hooked members comprise respective ends of at least one elongated rod affixed to said enclosure.

5. The pouch recited in claim 4 wherein said closure comprises a zipper having a zipper tab which must be translated to open and close said zipper.

6. The pouch recited in claim 5 said locking device having means for preventing translation of said zipper tab while said locking device is locked.

7. A tamper evident document pouch comprising:

a tear resistant, substantially rectangular enclosure having at least two hooked members extending longitudinally therefrom for hanging said pouch in a file cabinet drawer on file cabinet rails;

said enclosure having a unitary closure selectively secured in a closed configuration by a locking device, said locking device having means for opening only by leaving irrefutable evidence of such opening;

wherein said hooked members comprise respective ends of at least one elongated rod affixed to said enclosure;

wherein said elongated rod has an intermediate stepped portion to prevent rotation of the rod.

* * * * *